US010240821B2

(12) United States Patent
Bin-Nun

(10) Patent No.: US 10,240,821 B2
(45) Date of Patent: Mar. 26, 2019

(54) STIRLING ENGINE DISPLACER DRIVE

(71) Applicant: FLIR Systems, Inc., Wilsonville, OR (US)

(72) Inventor: Uri Bin-Nun, Chelmsford, MA (US)

(73) Assignee: FLIR SYSTEMS, INC., Wilsonville, OR (US)

( * ) Notice: Subject to any disclaimer, the term of this patent is extended or adjusted under 35 U.S.C. 154(b) by 208 days.

(21) Appl. No.: 15/343,023

(22) Filed: Nov. 3, 2016

(65) Prior Publication Data

US 2017/0051951 A1 Feb. 23, 2017

Related U.S. Application Data

(63) Continuation of application No. 13/398,024, filed on Feb. 16, 2012, now Pat. No. 9,574,797.

(60) Provisional application No. 61/514,411, filed on Aug. 2, 2011.

(51) Int. Cl.
*F25B 9/14* (2006.01)

(52) U.S. Cl.
CPC ..... *F25B 9/14* (2013.01); *F25B 2309/003* (2013.01); *F25B 2500/06* (2013.01); *F25B 2500/12* (2013.01)

(58) Field of Classification Search
CPC .. F25B 9/14; F25B 2309/003; F25B 2500/12; F25B 9/00
See application file for complete search history.

(56) References Cited

U.S. PATENT DOCUMENTS

| | | | | |
|---|---|---|---|---|
| 3,515,034 | A | 6/1970 | Eklund | |
| 4,471,626 | A * | 9/1984 | Sarcia | F25B 9/14 505/892 |
| 4,804,352 | A * | 2/1989 | Schmidt | B64C 27/41 384/221 |
| 5,056,317 | A * | 10/1991 | Stetson | F25B 9/14 60/520 |
| 7,587,896 | B2 * | 9/2009 | Bin-Nun | F25B 9/14 60/517 |
| 2007/0261407 | A1 | 11/2007 | Bin-Nun et al. | |
| 2007/0261419 | A1 * | 11/2007 | Bin-Nun | F25B 9/00 62/6 |
| 2012/0017607 | A1 | 1/2012 | Bin-Nun et al. | |

FOREIGN PATENT DOCUMENTS

| | | |
|---|---|---|
| EP | 0339836 | 2/1989 |

* cited by examiner

*Primary Examiner* — Elizabeth J Martin
(74) *Attorney, Agent, or Firm* — Haynes and Boone, LLP

(57) ABSTRACT

A cryocooler is provided that includes: a regenerator piston; a drive coupler; and a link flexure having a proximal end coupled by a first pin to the drive coupler and having a distal end coupled by a second pin to the regenerator piston, where the link flexure forms a vane having flattened opposing faces that are orthogonal to a longitudinal axis for the first and second pin.

20 Claims, 7 Drawing Sheets

STIRLING ENGINE DISPLACER DRIVE

CROSS-REFERENCE TO RELATED APPLICATION

This application is a continuation of and claims priority to U.S. patent application Ser. No. 13/398,024, filed Feb. 16, 2012, which claims the benefit of U.S. Provisional Patent Application No. 61/514,411, filed Aug. 2, 2011, the contents of which are hereby incorporated by reference in their entirety.

TECHNICAL FIELD

The present invention relates generally to Stirling engines, and more particularly to an improved Stirling engine displacer drive.

BACKGROUND

Cryocoolers systems are used, for example, to cool infrared sensors during operation. A cryocooler system typically includes a reciprocating compression piston and a reciprocating regenerator/displacer piston. In some cryocooler systems a single rotary motor is used to drive both pistons. Such systems include a first drive coupling disposed between a shaft of the rotary motor and the compression piston and a second drive coupling disposed between the shaft of the rotary motor and the regenerator piston. Rotation of the motor shaft is coupled to each piston thereby reciprocally driving each piston within a drive cylinder. The reciprocating motion of the pistons is out of phase with each other.

It is a conventional problem that the piston drive couplings induce vibrations in the cryocooler system. These vibrations are coupled to the infrared sensor and can degrade image quality. It is particularly problematic when the piston drive couplings excite elements of the cryocooler system at their natural frequency. It is a further problem that the piston drive couplings generate undesirable audible noise. Undesirable vibrations and audible noise are partially caused by excess looseness and also by misalignment of the coupling elements.

To reduce excess play and improve audible noise, it is conventional to tighten coupling element mechanical joint fit tolerances. For example, the drive coupling drives the regenerator piston through a regenerator link that attaches to the drive coupling through a connecting pin. The drive coupling, the regenerator link, and the regenerator piston thus each have corresponding bearings to receive the connecting pins. The clearance between the connecting pin bearings and the connecting pins represents a common type of mechanical joint fit tolerance that is tightened to reduce excess play and noise. However, as this clearance is reduced towards zero, the ever tighter mechanical coupling leads to regenerator link failure due to high stresses induced by misalignment leading to bending stresses. Such a close tolerance may cause the cooler to operate at maximum input power and maximum rpm, leading to accelerated failure of other moving parts such as ball bearing, linkages and related components. In particular, small misalignments between the motor drive shaft longitudinal axis and the regenerator piston longitudinal axis (ideally, the alignment is perfectly orthogonal) forces the regenerator link to bend in a cyclical fashion as the drive coupling actuates. The regenerator link is thus subject to cyclical stress in a misaligned cryocooler, which leads to material fatigue or catastrophic failure of the connecting rod. But due to real-world manufacturing tolerance issues, it is unfeasible to guarantee that the motor shaft longitudinal axis is perfectly orthogonal to the regenerator piston longitudinal axis. The resulting cyclical bending of the linkage results in rubbing of the expander displacer against the inner cylinder walls, which leads to frictional build-up of heat at the cold end and thus reduced cooling capacity. In addition, the cylinder wall rubbing increases noise significantly.

Accordingly there is a need in the art for improved mechanical cryocooler linkages that enable tightened mechanical tolerances without inducing excessive bending stresses. In addition, there is a need in the art for improved mechanical cryocooler linkages that enable tightened mechanical tolerances while providing increased cooling capacity and noise reduction.

SUMMARY

In accordance with a first aspect of the disclosure, a cryocooler is provided that includes a regenerator piston; a drive coupler; and a link flexure having a proximal end coupled by a first pin to the drive coupler and having a distal end coupled by a second pin to the regenerator piston, wherein the link flexure forms a vane having flattened opposing faces that are orthogonal to a longitudinal axis for the first and second pin.

In accordance with a second aspect of the disclosure, a cryocooler link flexure for connecting between a drive coupler and a regenerator piston is provided that includes: an elongated shaft forming a vane having opposing flat faces extending between a proximal end and a distal end, wherein the distal end is configured to receive a regenerator connecting pin and the proximal end is configured to receive a drive coupler connecting pin, and wherein a longitudinal axis for the regenerator connecting pin is parallel to the drive coupling connecting pin, and wherein the opposing flat faces are orthogonal to the pin longitudinal axes.

In accordance with a third aspect of the disclosure, a method is provided that includes: reciprocating a regenerator piston within a cold finger to cool a distal end of the cold finger approximate an object; driving the reciprocation of the regenerator piston by rotating a motor shaft that drives a drive coupling, wherein a longitudinal shaft of the motor shaft is misaligned with regard to an orthogonal alignment with a longitudinal axis of the regenerator piston; and accommodating the misalignment through a flexing of a link flexure linking the drive coupler to the regenerator piston through a vane with opposing faces, wherein the opposing faces are parallel to a plane that is orthogonal to the longitudinal axis of the motor shaft.

DETAILED DESCRIPTION

Figure 1:
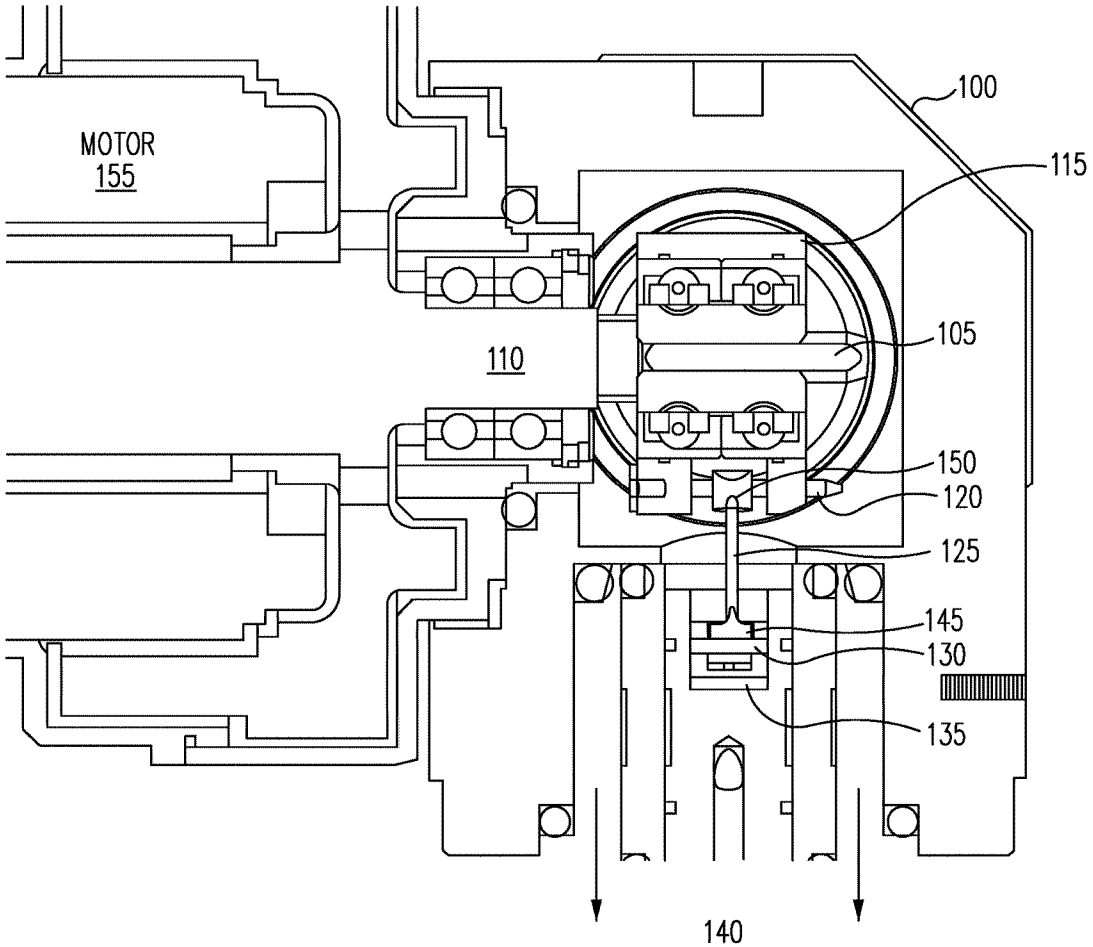
FIG. 1 is a longitudinal cross sectional view of a cryocooler crankcase and a proximal base of an adjoining cold finger in accordance with an embodiment.
Figure 2:
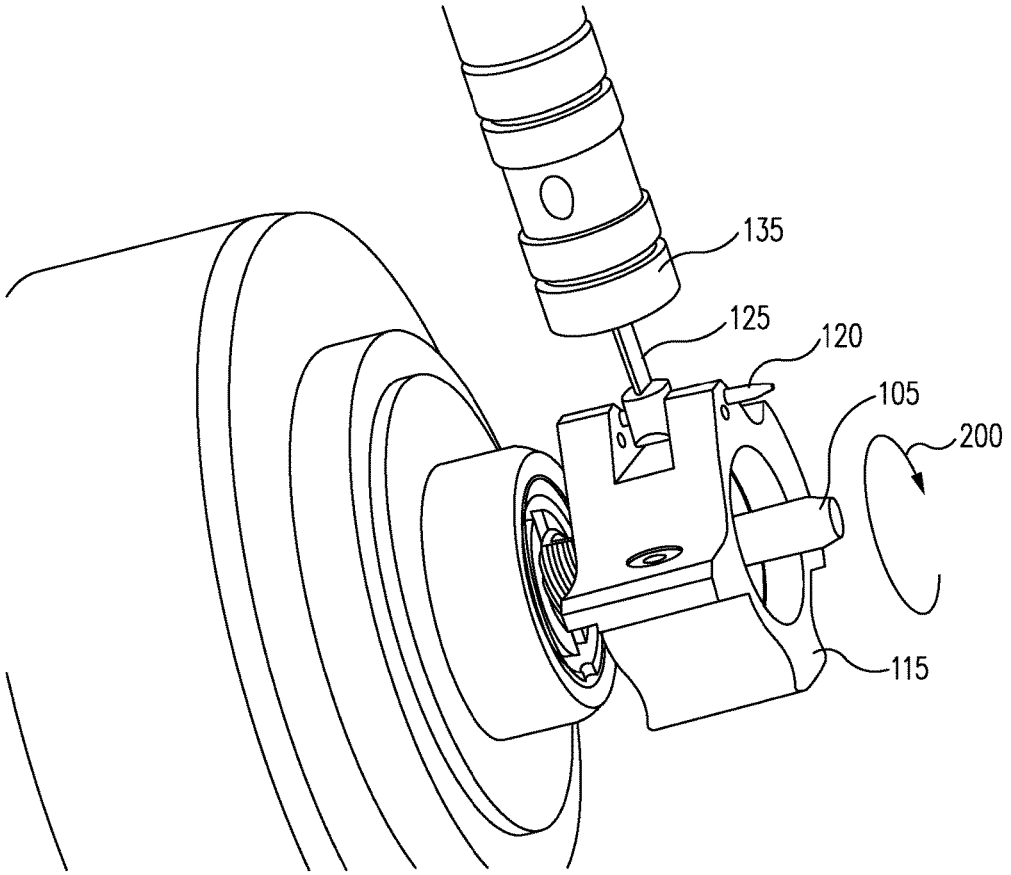
FIG. 2 is a perspective exploded view of the crankcase components in the cryocooler of FIG. 1 in accordance with an embodiment.

Turning now to the drawings, the improved mechanical cryocooler mechanical linkages disclosed herein may be better understood with regard to a Stirling cryocooler crankcase 100 as shown in FIGS. 1 and 2. A drive crank pin 105 is mounted off-center with respect to a motor shaft 110. Thus as motor shaft 110 spins, drive crank pin 105 will traverse a circular path 200 of FIG. 2 about a central longitudinal axis for motor shaft 110. A drive coupler 115 engages drive crank pin 105 through a bearing such that drive coupler 115 does not spin but instead just follows circular path 200. A first crank pivot pin 120 connects a proximal end of a regenerator link 125 to drive coupler 115.

Similarly, a second crank pivot pin 130 connects a distal end of regenerator link 125 to a regenerator piston's connecting cap 135.

As drive coupler 115 traverses circular path 200, the same circular motion is imparted to first crank pivot pin 120 and thus to regenerator link 125. A reciprocating motion of regenerator piston 135 is produced from the circular motion of drive coupler 115 when a motor 155 rotates motor shaft 110 of FIG. 1. This reciprocation is with respect to a longitudinal axis of a cold finger (not illustrated) that encloses piston 135.

Figure 3:
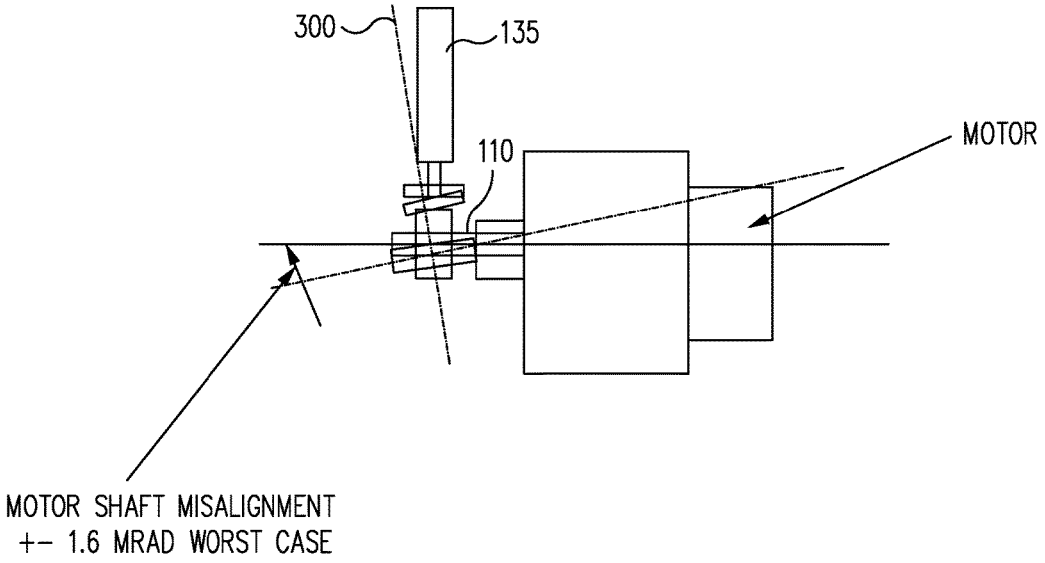
FIG. 3 illustrates a misalignment between the drive motor shaft longitudinal axis and the regenerator piston longitudinal axis in accordance with an embodiment.

To reduce vibration and noise as well as to reduce friction-induced heat losses caused by rubbing of piston 135 with the cold finger cylinder's wall, the clearance between second crank pivot pin 130 at the distal end of regenerator link 125 and a receiving bearing 145 should be as close to zero as manufacturing techniques permit. A similar tight clearance may be maintained between first crank pivot pin 120 and a receiving bearing 150. But such tight tolerances aggravate a bending of regenerator link 125 that occurs due to a misalignment between a central longitudinal axis for motor shaft 110 and a longitudinal axis for regenerator piston 135. This misalignment is shown in FIG. 3. The bending of regenerator link 125 causes piston 135 to rub against the cold finger cylinder walls, which reduces cooling capacity and increases noise.

In an ideal manufacture, a central longitudinal axis 300 of piston 135 is orthogonal to a central longitudinal axis of motor shaft 110. But due to real-world manufacturing tolerances, motor shaft central longitudinal axis 305 may be tilted from orthogonality to piston longitudinal axis 300 by as much as 1.6 mrad or more. This misalignment combined with the tight clearances between the pins and the corresponding pin bearings for regenerator link 125 causes regenerator link 125 to cyclically bend as discussed previously. In addition, the misalignment causes piston 135 to rub with the cold finger cylinder walls as discussed above. To accommodate the bending stress, a conventional regenerator link such as link 125 comprises a cylindrical shaft for greatest longitudinal rigidity. The bending of such a cylindrical shaft leads to link failure due to mechanical fatigue and stress cracks.

Figure 4:
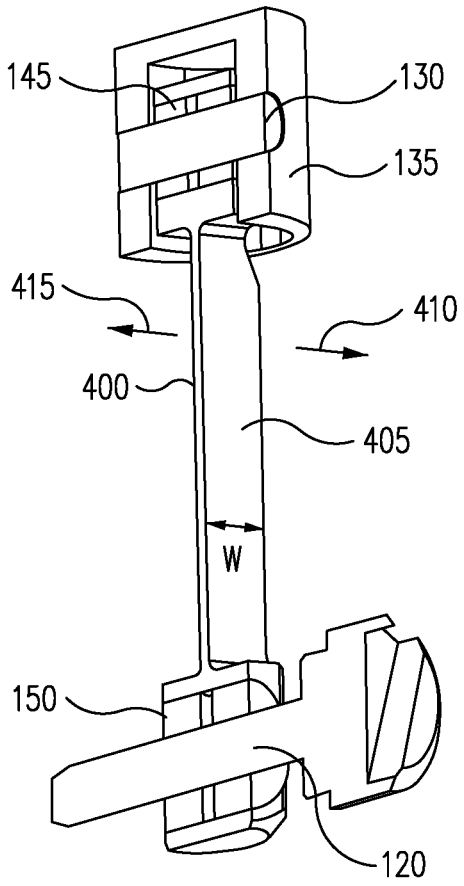
FIG. 4 is cross-sectional view of a link flexure that accommodates the misalignment shown in FIG. 3 in accordance with an embodiment.
Figure 5:
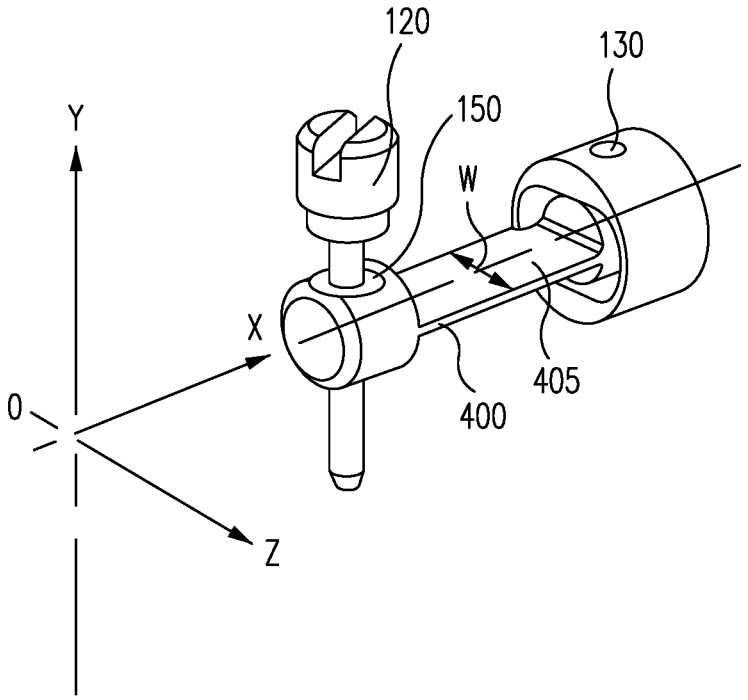
FIG. 5 is a perspective view of the link flexure of FIG. 4 in accordance with an embodiment.

The stress-induced link failure can be partially mitigated by making the regenerator pin-to-bearing clearances looser but that in turn leads to piston vibration and noise. The resulting vibration is particularly problematic if the cryocooler is to be used to cool an infrared imager in that the images are blurred by the vibration. A regenerator link flexure 400 such as shown in FIG. 4 advantageously accommodates such misalignment yet enables tight clearances between second crank pivot pin 130 and bearing 145 as well as between first crank pivot pin 120 and link bearing 150. Link flexure 400 forms a vane with opposing flat faces 405 having a width W that is orthogonal to the longitudinal axis for pin 120. Since link flexure 400 has a thin depth as compared to width W, flexure 400 will be relatively flexible in the transverse direction normal to width W as indicated by arrows 410 and 415. This flexibility is shown again in FIG. 5, where a longitudinal axis for flexure 400 is considered to be parallel with the X axis of a Cartesian coordinate system having an origin at reference point 0. A longitudinal axis of pin 120 is parallel with the Y axis. The width W of flat face 405 is thus parallel with the Z axis. Thus flexure 400 is relatively flexible with regard to rotation on the Z axis (from a linear force applied to the distal end of flexure 400) but relatively stiff with regard to buckling along the X axis and very stiff with regard to bending about the Y axis.

Figure 6:
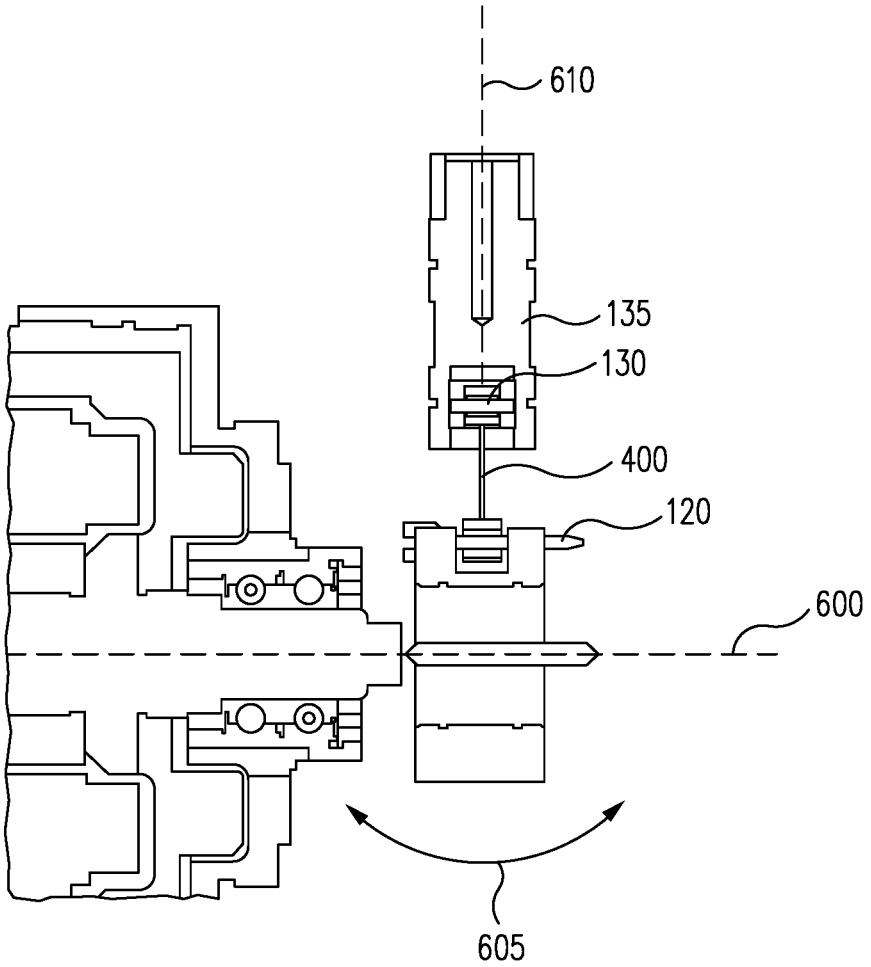
FIG. 6 is a longitudinal cross-sectional view of the link flexure of FIG. 4 as incorporated into a cryocooler regenerator piston drive mechanism in accordance with an embodiment.
Figure 7:
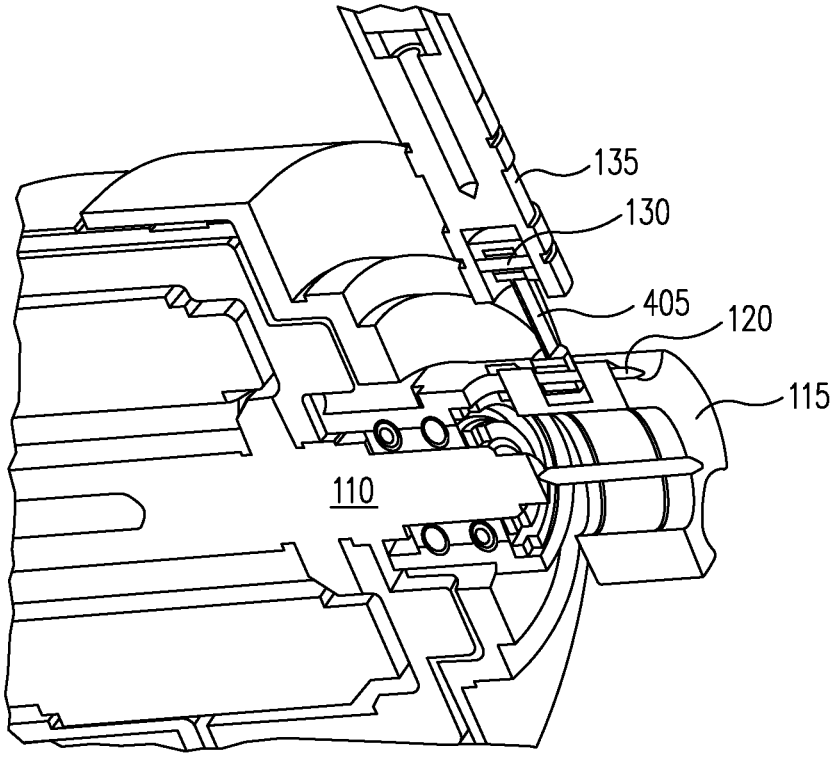
FIG. 7 is a perspective view of the mechanism of FIG. 6, partially cut-away in accordance with an embodiment.

It may be seen that opposing flat faces 405 for link flexure 400 are aligned orthogonally to a longitudinal axis for both pins 130 and 120. As seen in the cross-sectional view of FIG. 6, the resulting flexibility of link flexure 400 accommodates a misalignment of a motor shaft longitudinal axis 600 and a regenerator piston longitudinal axis 610. As shown, these axes are properly orthogonal. But if motor axis 600 is misaligned with axis 610 as discussed with regard to FIG. 3, link flexure 400 may flex as indicated by double-headed arrow 605 to relieve any resulting mechanical stress. In contrast, a conventional cylindrical link flexure would be mechanically stressed by such bending. In addition, the bending stress on a conventional cylindrical link flexure would cause the expander piston to rub against the cold finger cylinder wall. FIG. 7 shows in perspective view the alignment of opposing faces 405 with regard to the longitudinal axes for pins 120 and 130. Opposing faces 405 are parallel with planes that are orthogonal to these longitudinal axes as well as the longitudinal axis of motor shaft 110.

In one embodiment, link flexure 400 may comprise titanium. Titanium has the unique property of highest elasticity to strength ratio as compared with steel or aluminum. Also, titanium is known for possessing higher damping coefficient than steel or aluminum and thus provides for better noise and vibration control/reduction. The advantageous flexibility of link flexure 400 was designed to operate at zero "line to line" fit such as 0.0002 to 0.000050 inches with regard to the clearances between pins 120 and 130 and their respective bearings 150 and 145 while keeping misalignment induced stress to a minimum. This combination of low stress and high mechanical compliance advantageously provides an optimal solution to minimize audible noise and enhance reliability. Moreover, such a link flexure reduces heat build up at the cold end by minimizing frictional contact between the piston and the cylinder wall. In addition, titanium is known for superior machinability when it come to thin wall structures. Its low bending natural frequency reduces vibration loads caused by misalignment, which results in lower self induced vibration as compared to hardened-tool-steel-based flexure designs, thereby reducing vibrational ringing.

As those of some skill in this art will by now appreciate and depending on the particular application at hand, many modifications, substitutions and variations can be made in and to the materials, apparatus, configurations and methods of use of the devices of the present disclosure without departing from the spirit and scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. A cryocooler, comprising:

a drive coupler;

a motor shaft for driving the drive coupler;

a regenerator piston; and a link flexure having a proximal end coupled by a first pin to the drive coupler and having a distal end coupled by a second pin to the regenerator piston, wherein the link flexure forms a vane having flattened opposing faces that are aligned orthogonally to a longitudinal axis of the motor shaft.

2. The cryocooler of claim 1, wherein the link flexure comprises titanium.

3. The cryocooler of claim 1, wherein the link flexure comprises steel.

4. The cryocooler of claim 1, wherein the link flexure comprises aluminum.

5. The cryocooler of claim 1, further comprising a motor operable to rotate the motor shaft, wherein the link flexure is configured to accommodate a relative alignment between the longitudinal axis of the motor shaft and a longitudinal axis of the regenerator piston.

6. The cryocooler of claim 1, wherein the link flexure is configured to provide flexibility in a transverse direction normal to the width of the flattened opposing faces.

7. The cryocooler of claim 1, further comprising a link flexure bearing configured to receive the second pin, and wherein a clearance between the link flexure bearing and the second pin is less than or equal to 0.0002 inches.

8. The cryocooler of claim 1, further comprising a link flexure bearing configured to receive the first pin, and wherein a clearance between the link flexure bearing and the first pin is less than or equal to 0.0002 inches.

9. A cryocooler link flexure for connecting between a drive coupler and a regenerator piston, the cryocooler link flexure comprising:

an elongated shaft forming a vane having opposing flat faces extending between a proximal end and a distal end, wherein the distal end is configured to receive a regenerator connecting pin to couple the distal end to the regenerator piston and the proximal end is configured to receive a drive coupler connecting pin to couple the proximal end to the drive coupler, wherein a longitudinal axis of the regenerator connecting pin is parallel to a longitudinal axis of the drive coupler connecting pin, and wherein the opposing flat faces are orthogonal to a longitudinal axis of a motor shaft for driving the drive coupler such that the link flexure is configured to allow the drive coupler to produce a reciprocating motion for the regenerator piston and to orient the opposing flat faces of the link flexure relative to the regenerator piston and the motor shaft to provide flex to accommodate a relative alignment between the longitudinal axis of the motor shaft and a longitudinal axis of the regenerator piston substantially without inducing additional frictional contact between the regenerator piston and a cylinder wall.

10. The cryocooler link flexure of claim 9, wherein the cryocooler link flexure comprises titanium.

11. The cryocooler link flexure of claim 9, wherein the cryocooler link flexure comprises steel.

12. The cryocooler link flexure of claim 9, wherein the cryocooler link flexure comprises aluminum.

13. The cryocooler link flexure of claim 9, further comprising a first link flexure bearing for receiving the drive coupler connecting pin and a second link flexure bearing for receiving the regenerator connecting pin.

14. A method of cooling an object, the method comprising:

reciprocating a regenerator piston within a cold finger to cool a distal end of the cold finger proximate the object;

driving the reciprocation of the regenerator piston by rotating a motor shaft that drives a drive coupler; and flexing a link flexure that links the drive coupler and the regenerator piston to accommodate a relative alignment between a longitudinal axis of the motor shaft and a longitudinal axis of the regenerator piston, wherein the link flexure forms a vane with flattened opposing faces, and wherein the longitudinal axis of the motor shaft is aligned orthogonally to the flattened opposing faces.

15. The method of claim 14, wherein the object is an infrared sensor.

16. The method of claim 14, wherein reciprocating the regenerator piston displaces a working gas with respect to the cold finger.

17. The method of claim 14, further comprising linking the link flexure to the drive coupler through a first pin.

18. The method of claim 17, further comprising linking the link flexure to the regenerator piston through a second pin.

19. The method of claim 18, wherein the flattened opposing faces are aligned orthogonally to a longitudinal axis of the first pin.

20. The method of claim 19, wherein the flattened opposing faces are aligned orthogonally to a longitudinal axis of the second pin.

* * * * *